United States Patent [19]

Hope et al.

[11] 3,989,176

[45] Nov. 2, 1976

[54] WEB TRANSPORTING SYSTEM

[76] Inventors: Henry F. Hope, 3192 Huntingdon Road, Huntingdon Valley, Pa. 19006; Stephen F. Hope, 2421 Wyandotte Road, Willow Grove, Pa. 19090

[22] Filed: Mar. 10, 1975

[21] Appl. No.: 555,961

Related U.S. Application Data

[63] Continuation-in-part of Ser. Nos. 457,829, April 4, 1974, abandoned, and Ser. No. 513,244, Oct. 9, 1974.

[52] U.S. Cl. ..... 226/189

[51] Int. Cl.[2] ..... B65H 17/22

[58] Field of Search ..... 226/188, 189; 354/319–322, 339, 312–314, 316

[56] References Cited

UNITED STATES PATENTS

| | | | |
|---|---|---|---|
| 2,817,514 | 12/1957 | Parkes | 226/119 X |
| 3,073,590 | 1/1963 | Romeo | 271/274 |
| 3,078,024 | 2/1963 | Sardeson | 226/119 |
| 3,366,025 | 1/1968 | Layne | 354/322 |
| 3,785,543 | 1/1974 | Lee | 226/189 X |

FOREIGN PATENTS OR APPLICATIONS

| | | | |
|---|---|---|---|
| 736,265 | 6/1943 | Germany | 354/339 |

*Primary Examiner*—Richard A. Schacher
*Attorney, Agent, or Firm*—Weiser, Stapler & Spivak

[57] ABSTRACT

A conveyor system for transporting a web is described especially suitable for photographic development equipment, including a plurality of rotatable web transporting members such as rollers, which are driven at uniform surface speed, a plurality of power transmitting gears which are driven together and a plurality of cluster drive gears coaxially connected to respective power transmitting gears and driven thereby at the same rate of rotation. The pitch diameter of the power transmitting gears is larger than the pitch diameter of the cluster drive gears. The system also provides a plurality of clusters of gears which are driven by cluster drive gears to rotate the rollers.

The web is transported through the system at uniform speed.

101 Claims, 13 Drawing Figures

200
202
204
206
208
210
212
214
216
218
220
222
224
226
228
230
282
283
284
285
286
287
288
290
292
294
296
297
298
299
300
301
302
303
304
305
306
318
319
320
321
322
323
324
326
328
330

WEB TRANSPORTING SYSTEM

RELATED CASES

This application is a continuation-in-part of our copending United States applications Ser. No. 457,829 filed Apr. 4, 1974 now abandoned, and Ser. No. 513,244 filed Oct. 9, 1974.

BACKGROUND OF THE INVENTION

The present invention relates generally to a conveyor system for moving webs or sheets of material with maximum efficiency, with minimum power requirements and with minimal chatter, vibration and deflection. This system is especially suitable for photographic development equipment.

Machines which require an extended transport roller system for carrying a flexible workpiece, like film or papers, are known. Typical prior art types of conveyors are disclosed in U.S. Pat. Nos. 3,336,025 to L yne, 3,078,024 to Sardeson, 3,435,749 to Cauwe et al., and 3,520,461 to Savela.

In typical prior art systems, one cluster of gears is serially connected to the next cluster of gears. As a result the input torque required to overcome friction increases with each added mesh so that the total input torque required is a function of the total number of meshes, bearings, pitch diameters, etc. This is illustrated by the Layne patent.

Moreover, the conveyors of the prior art, such as those Savela and Cauwe et al., have serious operating difficulties in that the long gear train with multitudinous meshing gears from top to bottom has excessive friction and tends to bind. Such gear trains thus limit the height of the unit and the length of the path available for the web. Moreover, such gear trains do not provide uniformity of movement of the web and are subject to vibration and chatter causing unsatisfactory film quality.

The gear drives of the prior art conveyors follow accepted principles of design that a continuous train is simplest to design, assemble and service, that a continuous gear train of the smallest possible gears produces a lighter weight and smaller overall package, that the use of small diameter gears minimizes gear cost and results in an optimum gear quality, and that the smaller diameter gears have a lower pitchline velocity and will therefore wear less, last longer and be quieter in action and will give less of a thermal expansion problem.

Thus, the web transport systems of the prior art, with their long series of driven roller assemblies, are beset with the problem of the transmission of power to all these rollers through the corresponding long train of meshing power transmitting gears. For such gear trains, input torque required to overcome friction increases with each added meshing. The difference between the magnitudes of output and input power is attributable to losses due to gear teeth meshing and shaft bearing friction. Such conventional systems show a relatively rapid fall-off of efficiency with length. As shown by conventional systems in use, the number of rollers which can in practice be driven by such a system is severely limited. Also, the play between gear teeth is cumulative with the number of gear meshings, causing objectionable gear chatter, vibration and deflection, all of which increase as the distance from the input power drive increases. In the case of photographic film processing machines, these defects are critical. They are the cause of damage to the delicate photographic film, the film emulsion can become marked, and the film can show the effect of the uneven transport through the system.

SUMMARY OF THE INVENTION

The system of the invention for conveying sheet material departs from the conventional systems in several features. The system embodying the invention is characterized by separation of those gears which transmit the main power along the conveyor system from those gears which drive the individual rollers. Power supply, like a motor, is provided to at least one of these power transmitting gears. The main driving power is transmitted through a plurality of power transmitting gears. From these power transmitting gears, there are tapped off fractions of this main driving power sufficient to drive several clusters of gears which, in turn, drive fractions of the total number of transport rollers in the system. The drive from each power transmitting gear to the associated clusters of roller-driving gears takes place through a cluster drive gear, which is usually coaxially connected to the power transmitting gear. No power is transmitted but through the connection between the power gear and its associated cluster drive gear.

The specific relationships between gear ratios, roller diameters and other pertinent parameters are so chosen that the web is transported at substantially uniform speed.

As is seen from the prior art, the problems of efficient transmission of power over long distances and the problem of the manner in which the work is to be done by each element of the conveyor, are mixed up, attempts to correct either one adversely affects the other, so that none is adequately solved. The present invention allows each problem to be solved separately without detriment to the solution of the other.

The system has high efficiency, low gear chatter, and little vibration and therefore provides smooth, uniform and trouble-free web transport especially through long trains of web rollers.

As will be shown, the system of the invention has improved efficiency of torque transmission. The number of gear meshes in the main line flow of torque is reduced and, consequently, the total losses from friction and other causes are also minimized.

Other features of the invention are as follows. The power gears are preferably as large as possible consistent with the available space. They are preferably in a 1:1 velocity ratio to each other, and with the largest number of gear teeth. This provides superior power gear tooth-to-tooth matching. The pitch diameters of the power transmission gears are preferably several times larger than those of the cluster drive gears coaxially connected thereto. This provides multiplication of driving forces from the power transmission gears to the cluster drive gears, therefore, the forces transmitted along the power gears are minimized and bearing friction losses and strains are reduced. At the same time, gear chatter and vibration are reduced throughout the system.

Other features and advantages will be pointed out in the detailed description.

In the preferred embodiment, the present invention includes at least one side carrier within which are journalled a plurality of rollers for transporting a web, which may be of photographic material such as film. A plurality of large power transmitting gears are mounted on the carrier and are driven simultaneously by single power source. Each power transmitting gear rotates a small cluster drive gear at the same rate of rotation. Each cluster drive gear meshes witth a cluster of driven satellite gears, to rotate a number of web transporting rollers in unison. Preferably, the cluster gears are balanced about the cluster drive gear and are mounted on a second side carrier. The speed of the rollers is such as to transport the web at a substantially uniform speed.

By breaking up the load into a plurality of cluster groupings, a plurality of short cluster gear trains are provided. The short gear cluster trains have less gear inefficiency. These gear trains further produce less compounding of leverages and lower bearing loading, thereby making it possible to drive the composite system with less power.

While generally the power gears are of same pitch diameter, it is often desirable that some of the power transmitting gears be of different pitch diameter from each other. If required, they can all be of a different pitch diameter from each other. In all such situations, the relationship of the pitch diameter of the power transmitting gear and its associated cluster drive gear, is as explained herein.

As used herein, the term "web" should be taken to mean any strip or sheet of material bearing information, which may be applied through radiation (light, x-rays, etc.), sound, magnetism, or otherwise. This information when developed can be visually or audibly, or otherwise detectable. The "web" can be a synthetic material, like plastic, a cellulosic material, like paper or any other substrate for the information to be developed.

Accordingly, it is a principal object of this invention to provide a conveyor system for webs which operates in an improved manner, which requires less power, which has substantially reduced chatter, which has reduced maintenance requirements, and which permits employment of increased numbers of rollers within a single conveyor system.

A fuller understanding of the invention will be had by referring to the following description of the preferred embodiments thereof, taken in conjunction with the accompanying drawings, wherein like reference characters refer to similar parts throughout the several views in which:

DETAILED DESCRIPTION

Figure 1:
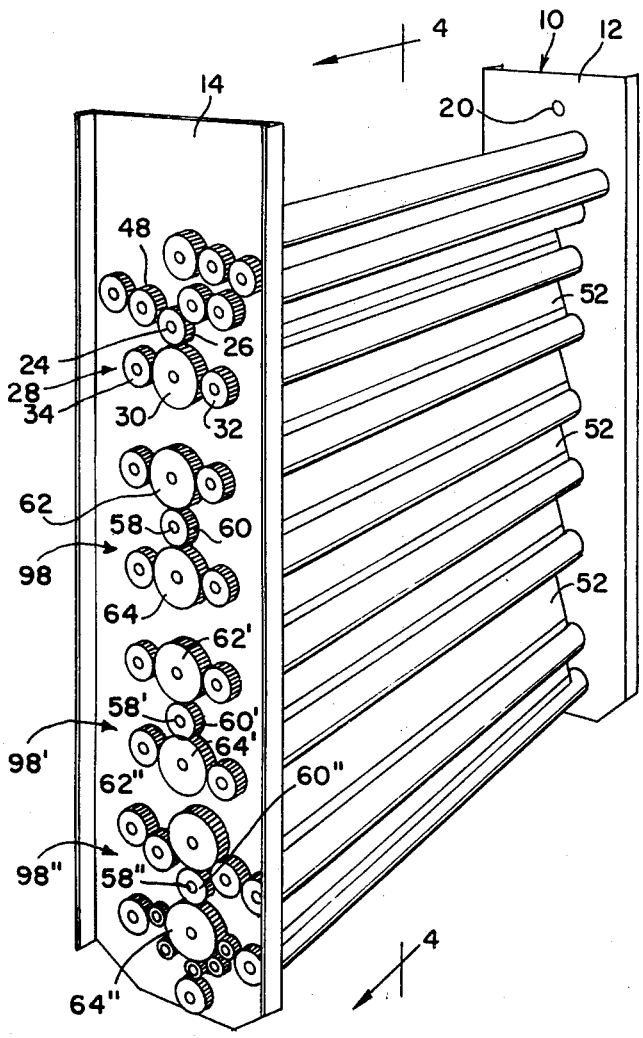
FIG. 1 is a perspective view of a web transporting roller assembly incorporating the gear drive system of the present invention.

Referring to FIGS. 1 – 4, we show the invention as applied to a roller assembly 10 suitable for conveying a web 15 such as a film and which includes a right side carrier 12, a left side carrier 14 and a web transporting roller system which is rotatively journalled therebetween. The roller assembly includes a plurality of rollers suitably positioned to transport the web 15 downwardly through a vertically elongated path between pairs of rollers 50, 51; 42, 44; 94, 86; 96, 88; 110, 112; 114, 116; 118, 112; 122, 124; through the turnabout rollers 126, 128, 130, 132 and then upwardly between the roller pairs 134, 136; 138, 140; 114, 142; 110, 144; 96, 92, 94, 90; 42, 46; 152, 154; and 153. A set of fixed web guides 52 are provided in conventional manner to further define the web path. Thus the web 15 is conveyed in the direction of the arrows 21, 23 (FIG. 4) by the various pairs of rollers. Quite often, the roller assembly 10 is immersed in a hostile atmosphere such as a chemical containing liquid (the liquid level being schematically indicated at 75). Because of this, the component parts such as the guides 52, side carriers 12, 14 and the gears and rollers are usually made of materials resistive to the corrosive effects of the liquid. In a preferred embodiment of the invention, the web 15 is a photographic material such as motion picture film, still camera film or x-ray film.

Figure 2:
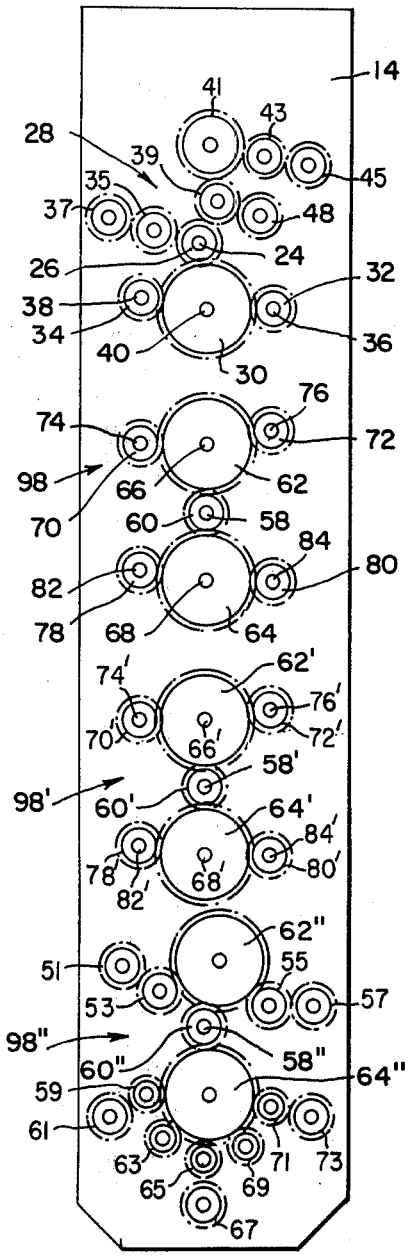
FIG. 2 is an enlarged, left side elevational view of the roller assembly of FIG. 1.
Figure 3:
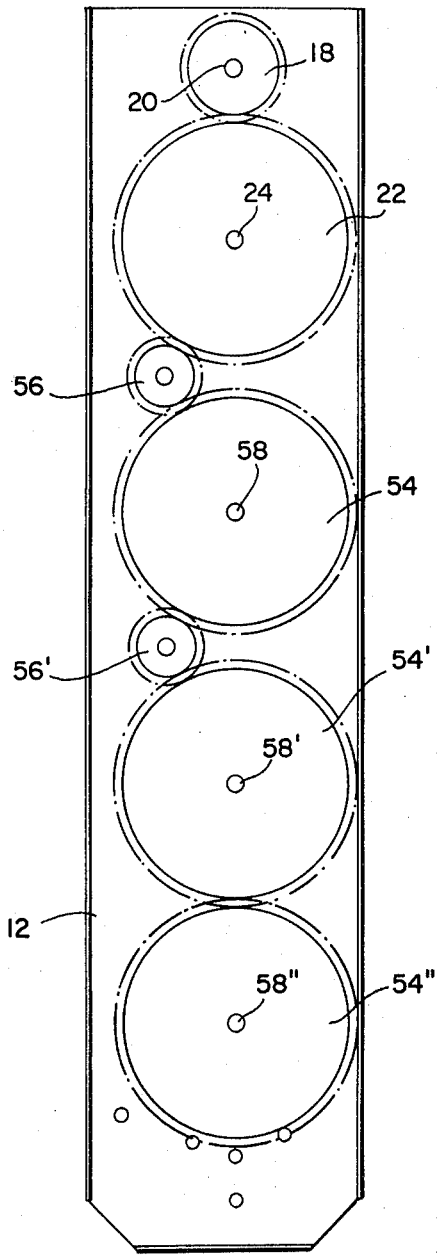
FIG. 3 is an enlarged, right side elevational view of the roller assembly of FIG. 1.

Referring to FIGS. 1, 2 and 3, a drive gear 18 (FIG. 3) powers the entire system through energy supplied by a power source, for example, an electric motor (not shown), which is conventionally applied to the drive gear 18 in a well known manner, such as by a toothed belt drive. The drive gear 18 rotates about its side carrier journalled shaft 20 and meshes with the uppermost large power gear 22 to rotate the large power gear 22 when the drive gear 18 is rotated. In one embodiment, the drive gear 18 may be constructed with forty teeth and the large power transmitting gear 22 may be fabricated with eighty teeth so that gear 22 rotates at half the rate of the drive gear 18. The drive gear 18 sequentially drives the vertically spaced large, similar power transmitting gears 22, 54, 54′, and 54″. Reversing gears 56, 56′, are provided where needed, in well known manner, to rotate the lower positioned, large power gears 54, 54′, 54″ in the desired direction. Thus, the main driving power for the system is transmitted via the large diameter power transmitting gears.

The large power gear 22 is pinned or otherwise securely affixed to the power shaft 24 to rotate the power shaft 24 as the uppermost large power gear itself is rotated. The power shaft 24 is journalled within the right and left side carriers 12, 14 and extends outwardly from the side carriers a sufficient distance to accommodate the uppermost large power gear 22 at the right of the right side carrier 12 and the uppermost cluster drive gear 26 at the left of the left side carrier 14. The uppermost cluster drive gear 26 is conventionally affixed to the power shaft 24 and rotates in unison with the uppermost large power gear 22. Rotary power from the power gear 22 is transmitted to the uppermost cluster drive gear 26 so that the cluster drive gear 26 becomes the driving gear for the upper cluster 28 of satellite gears. The cluster drive gear 26 is preferably fabricated with sixteen teeth, to thereby provide a five to one ratio with the eighty teeth of the uppermost large power gear 22. It will be noted (FIG. 4) that the power shaft 24 does not directly attach to any roller and that it is centrally positioned within the rack assembly 10 so as not to interfere with the movement of the web 15 therethrough. As hereinbefore set forth the ratio of pitch diameter of the large power gears to the pitch diameter or the crank circle diameter, when applicable, of the cluster drive gears is greater than one to one. Ratios of three to one, four to one and five to one have proved advantageous. Other ratios may be used, as desired for the construction of the system. It is to be noted too that the pitch diameter—or crank circle diameter—relationship between a power transmission gear and its associated cluster drive gear need not be all in the same ratio for all of such pairs of gears in the system. It is often desirable that the ratios vary from pairs to pairs of gears. For instance, one or more pairs may be in a 1 to 5, 1 to 4, 1 to 3 ratio or any desired fractions or multiples thereof. If deemed desirable, each pair of gears may have a different ratio relationship from the other pair in the system.

An intermediate driven gear 30 meshes with the cluster drive gear 26 and in turn drives the diametrically opposed roller drive gears 32, 34. The roller drive gears 32, 34 rotate their respective shafts 36, 38 and the intermediate driven gear 30 rotates its shaft 40 in response to power supplied by the power gear 22. The respective shafts 40 and 36, 38 each have rollers 42, 46, 44 affixed and function to rotate the rollers 42, 46 and 44. Preferably, the small roller drive gears 32, 34 are fabricated with sixteen teeth and accordingly, the small roller drive gears 32, 34 will rotate at the same speed as the cluster drive gear 26 inasmuch as all three gears have the same number of teeth and all are in mesh with the intermediate driven gear 30. Thus, the respective web transporting rollers 44, 46 are rotated in unison and at the same surface speed.

As illustrated, the upper cluster 28 of satellite gears may include a plurality of auxiliary gears 48, 35, 37, 39, 41, 43, 45, which conventionally rotate their shafts and which are employed to rotate such auxiliary rollers 50, 51, 152, 154, 153 as may be required or desirable to properly guide a material web 15 automatically into and out of the roller assembly 10. The auxiliary gears 35, 39 mesh with the uppermost small drive gear 26 to drive the gears 37, 41, 43, 45, 48 in accordance with well known gear train design principles in a manner to simultaneously rotate all of the auxiliary rollers 50, 51, 152, 154, 153 when power is supplied to the cluster drive gear 26. Suitable interior guides 52 are conventionally strategically positioned throughout the roller assembly 10 to function in conjunction with the rollers to automatically guide the material web 15 between the rollers to permit automatic operation without the occurrence of jams, buckling or other web handling defects.

Referring now to FIGS. 2 and 3, it will be seen that the gear cluster system previously described at the upper portion of the roller assembly 10 can be duplicated in a similar manner as many times as may be necessary for proper web handling within the roller assembly. A next lower positioned large power gear 54 receives rotative power from the drive gear 18 through the uppermost large power gear 22. When it is desired to rotate the upper two medial rollers 42, 94 in the same direction, the reversing gear 56 can be employed. As illustrated, the next lower positioned large power gear 54 meshes with the reversing gear 56 to rotate in unison with the uppermost large power gear 22 and in the same direction. The large power gear 54 rotates its shaft 58 to cause rotation of the next lower positioned cluster drive gear 60 which is positioned adjacent the other side carrier 14 and which is affixed to the shaft 58. The next cluster drive gear 60 meshes with the upper and lower intermediate driven gears 62, 64 to rotate these gears and their respective shafts 66, 68.

The upper intermediate driven gear 62 meshes with right and left roller drive gears 70, 72 which in turn rotate their respective associated shafts 74, 76. In this manner, the rollers 94, 90, 86 are simultaneously rotated. Similarly, the next lower positioned cluster drive gear 60 meshes with the lower intermediate driven gear 64 to rotate the gear 64 and its shaft 68. Right and left roller drive gears 78, 80 mesh with the lower intermediate driven gear 64 and are rotated thereby to rotate their respective roller shafts 82, 84. Each cluster receives rotative power from a different large power gear.

Thus, different groups of rollers are driven by different clusters of gears which derive their driving torque from different power transmitting gears in the main line of power transmission. Each gear cluster takes off only the power needed to drive their rollers. The main power for feeding all the roller clusters is transmitted via large diameter gears. This eliminates from the main line a large percentage of the gearing and bearings in the system. The large diameter gears in the mainline of power transmission reduce transmitted forces and bearing loads and so decrease power losses. This results in lower required input torque and permits the use of smaller motors or building longer conveyor systems without the springiness and chatter of conventional systems.

Figure 4:
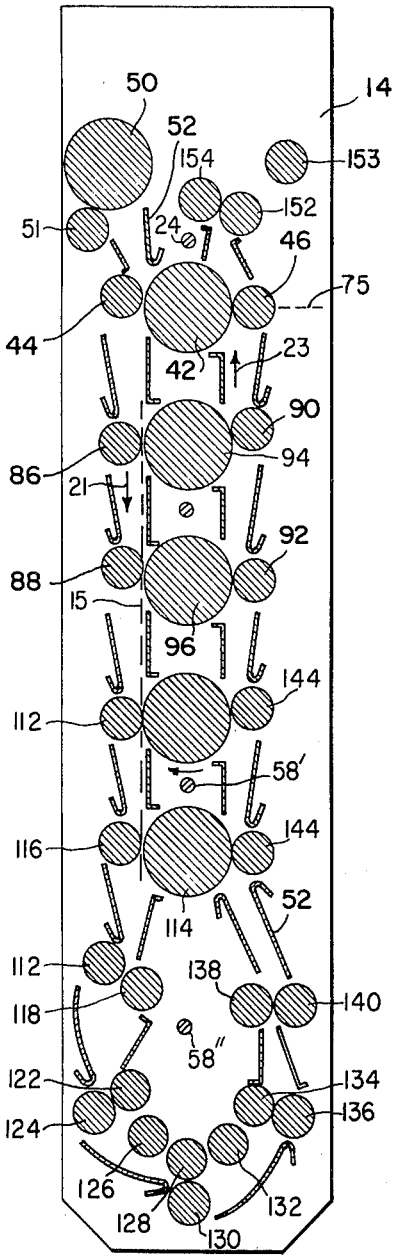
FIG. 4 is a cross sectional view taken along Line 4—4 of FIG. 1, looking in the direction of the arrows.

Rotation of the respective roller shafts 68, and 82, 84 cause simultaneous rotation of the small feed roller 88, small exit roller 92 and the medial roller 96 (FIG. 4). Thus, the combination of the gears 62, 64, 70, 72 and 78, 80 which all receive power from the cluster drive gear 60 form the second gear satellite cluster 98 which is similar in function and design to the upper gear satellite cluster 28. Similarly, additional, lower positioned satellite gear clusters 98′, 98″ can be developed by employing power from the same drive gear 18 simply by adding additional, lower positioned large power gears 54′, 54″ (FIG. 3), and additional reversing gear 56′ to rotate respective lower positioned power shafts 58′, 58″. It will be noted that no reversing gear is employed between the large power gears 54′ and 54″ in the configuration illustrated in FIG. 3. Accordingly, the lowest large power gear 54″ will rotate in the opposite direction from the direction of rotation of the large power gear 54′.

In accordance with the present design, only four large power transmitting gears 22, 54, 54′ and 54″ are illustrated as driven directly by the power drive gear 18. Each of the large power gears 22, 54, 54′ and 54″ in turn breaks down the forces required into distinct and separate satallite gear clusters 28, 98, 98′, 98″. See FIG. 2. Instead of a long, continuous gear train to rotate the rollers in accordance with usual gear train design techniques, wherein all of the gears 26, 30, 45, 32, 34, 35, 37, 39, 41, 43, 48, 60, 60′, 60″, 62, 62′, 62′, 64, 64′, 64′, 70, 70′, 72, 72′, 78, 78′, 80, 80′, 51, 53 55, 57, 59, 61, 63, 65, 67, 69, 71 and 73 would conventionally be sequentially driven by a common drive, the present design makes possible a simplified gear drive system which functions at greatly reduced power requirements.

The present design always employs the same gear cluster principle wherein a large power gear 22, 54, 54′ or 54″ is employed to rotate a smaller cluster drive gear 26, 60, 60′, 60″ through a power shaft 24, 58, 58′, 58″. In turn, each cluster drive gear 24, 60, 60′, 60″ is employed to rotate one or more intermediate driven gears 30, 62, 62′, 62″, 64, 64′, 64″ to thereby create separate and complete gear satellite clusters 28, 98, 98′, 98″. While the gears of any one cluster preferably do not mesh with those of any other cluster, such meshing may be provided, if desired, between two or more of the clusters, without thereby departing from the inventive concept.

Each of the intermediate positioned cluster drive gears 60, 60′ has clustered thereabout a plurality of gears associated directly and indirectly to drive the rollers of the processing rack 10. The intermediate gear clusters 98, 98′ are typical and indicate a preferred modular design whereby the processing rack 10 can readily be made larger or smaller by adding or subtracting satellite gear clusters 98, 98′ and their associated large power gears 54, 54′ and power shafts 58, 58′.

As best seen in FIGS. 2 and 3, the cluster drive gear 26 which is affixed to the upper power shaft 24 of the power gear 22 is the power source to the upper gear cluster 28. The drive gear 26 meshed directly with the roller gears, 35, 39, 30 and indirectly with the gears 32, 34, 37, 41, 43, 45 and 48. The gear 43 is not employed to rotate a roller, but rather is present to power the gear 45 and to allow correct positioning of the roller 153 to facilitate automatic movement of the web 15. The roller 50 as illustrated is rotated by frictional contact with the roller 51 in conventional manner and need not be gear driven. The various rollers have been positioned for optimum web handling purposes. The gearing to rotate the rollers has been designed in accordance with the present invention to be arranged into the various satellite gear clusters. Thus, at the top of the rank assembly, all of the web feed rollers and web exit rollers are driven by the satellite gear cluster 28 through the large power gear 22.

The large power gear 54″ through its power drive shaft 58″ powers the lowermost satellite gear cluster 98″ which is designed to rotate all of the rollers associated with turning the web at the bottom of the rack assembly 10 and then reversing the path of web travel to follow a U-shaped path. The cluster drive gear 60″ is turned by the power shaft 58″ and meshes with the gears 62″, 64″ which in turn directly drive the small roller gears 53, 55, 59, 63, 65, 69 and 71 and indirectly drive the roller gears 51, 57, 61, 67 and 73. Such an arrangement may be employed for web turnabout purposes. It will be appreciated that the lowermost satellite gear cluster 98″ represents only one method of turning a web and that the invention is not so limited. The web turning system may be modified by those skilled in the art to include many different roller designs and still come within the scope and meaning of this invention.

The intermediate large power gear 54 rotates its affixed power shaft 58 to thereby rotate the cluster drive gear 60 which is also affixed to the power shaft 58 and the satellite gear cluster 98. Rotation of the power gear 54 causes rotation of the rollers 86, 94, 90 and 88, 96, 92 about their respective shafts 76, 66, 74 and 84, 68 and 82. The next lower intermediate large power gear 54′ rotates its affixed power shaft 58′ to thereby rotate the cluster drive gear 60′ which is also affixed to the power shaft 58′. The power gear 54′ causes rotation of the rollers 112, 110, 144 and 116, 114, 142 about their respective shafts 76′, 66′, 74′ and 84′, 68′ and 82′. The satellite gear clusters 98, 98′ which are associated with the large power gears 54, 54′ are substantially identical for all practical purposes. Thus, the height of the rack assembly 10 can be readily varied by either adding or subtracting one or more satellite gear clusters such as 98, 98′ and their associated large power gears 54, 54′ and power shafts 58, 58′.

The entire force required to rotate all of the gears and rollers is applied to the uppermost large power gear 22 through the drive gear 18. All of the power gears 22, 54, 54′, 54″ are large gears and occupy essentially the entire front to rear width of the right and left side carriers 12, 14 between the flanges 100, 100′. Thus, the largest dimension of the large power gears is regulated by the width of the side carriers.

By maximizing the sizes of the power transmitting gears, within the limits of the available space, the number of bearings and gear meshes in the main line of power transmission is minimized. This, in turn, minimizes power losses and improves the efficiency of the web transport system.

Using large power transmitting gears also aids in the reduction of chatter and vibration in the system.

The ratio of pitch diameter of each power transmitting gear 22, 54, 54′, 54″ to the pitch diameter of the cluster gears 32, 34, 70, 70′, 72, 72′, 78 78′, 80, 80′ is greater than one, and as illustrated, is in the order of five to one. This step down ratio between power transmitting gears and the cluster gears reduces the transmitted gear vibration from the power side to the load side to thereby substantially eliminate chatter and resultant marking of the film.

Figure 5:
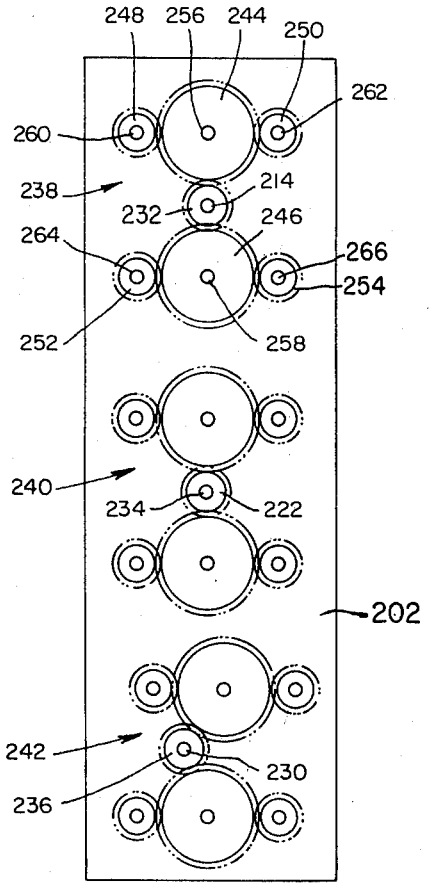
FIG. 5 is a rear elevational view of a gear system arranged in accordance with the present invention.
Figure 6:
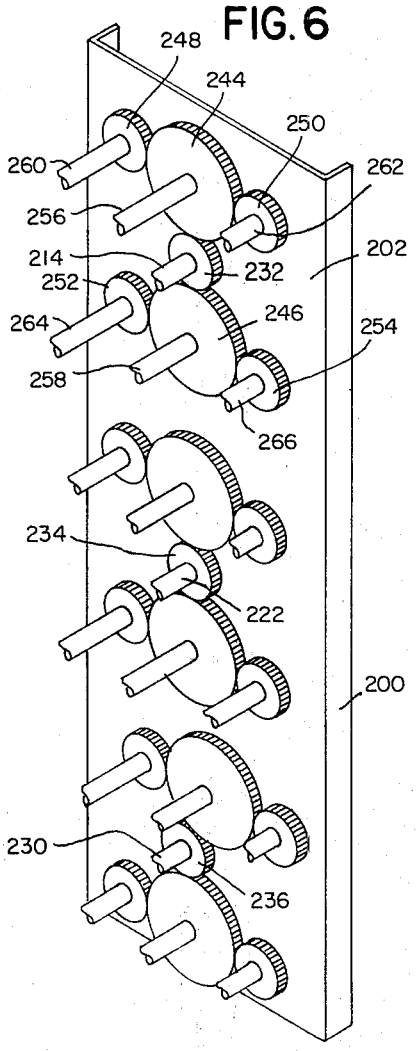
FIG. 6 is a perspective view of the apparatus of FIG. 5.
Figures 7, 8, 9, 10:
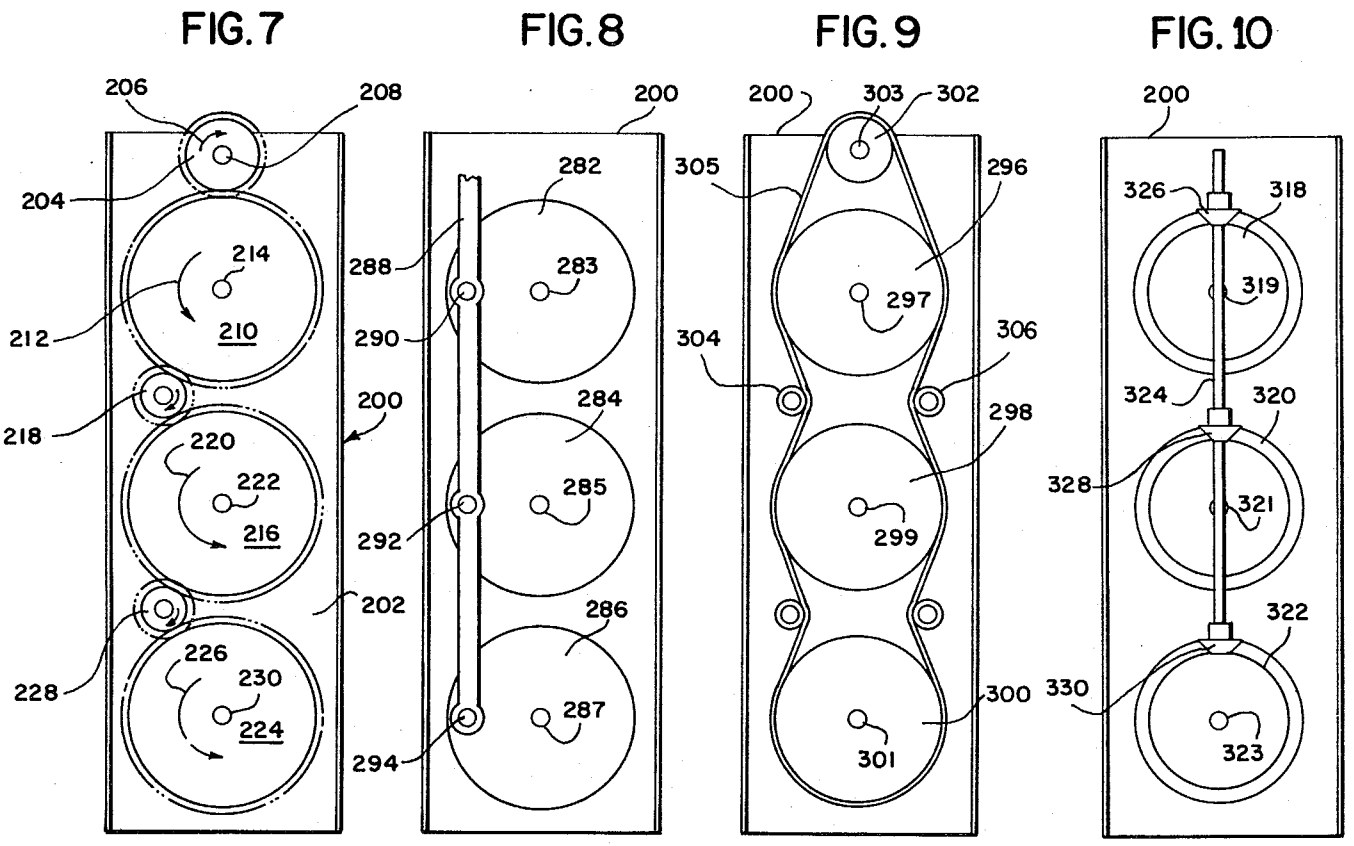
FIG. 7 is a front elevational view of the gear system of FIGS. 5 and 6.
FIG. 8 is a front elevational view similar to FIG. 7 showing a modification employing an eccentric drive.
FIG. 9 is a front elevational view similar to FIG. 7 showing a modification employing a chain or belt drive.
FIG. 10 is a front elevational view similar to FIG. 7 showing a modification employing a bevel gear drive.

In FIGS. 5, 6 and 7 there is shown another embodiment of the invention generally designated 200 and employing only a single support 202 for both the power transmitting gears and the satellite gear clusters. A driving gear 204 receives rotative power from a power source (not shown) such as an electric motor which may act through a toothed belt, and rotates in the direction of the arrow 206. The driving gear has its shaft 208 journalled within the support 202 and meshes with a large power transmitting gear 210 to rotate the power gear 210 in the direction of the arrow 212. The large power gear fixedly connects to a power shaft 214 and rotates the shaft 214 upon the application of rotative power from the driving gear 204.

The large power gear 210 is optionally in direct mesh with a juxtaposed, similar second large power gear 216 or else a reversing gear 218 is interposed therebetween. In the embodiment illustrated, the reversing gear 218 acts to rotate the second large power gear 216 in the direction indicated by the arrow 220. The second large power gear 216 fixedly connects to the second power shaft 222 in a manner to rotate the shaft 222 as the gear 216 is rotated.

Similarly, a third, juxtaposed, similar large power gear 224 is rotated in the direction of the arrow 226 by rotative power supplied by the large power gear 216 through the reversing gear 228. It will be noted that the third large power gear would rotate in the direction opposite to that indicated by the arrow 226 if the reversing gear 228 were omitted and the large gears 216, 224 were in direct mesh. Rotation of the third large power gear 224 rotates the third power shaft 230 for power transfer purposes in the manner hereinafter more fully set forth.

Referring now to FIG. 5, it will be observed that the first, second and third power shafts 214, 222, 230 each extend through the support 202 a sufficient distance to fixedly respectively receive a small cluster drive gear 232, 234, 236 thereon. Suitable bearings or bushings (not illustrated) are conventionally provided where the shafts 214, 222, 230 pass through the support 202 to permit free rotation thereabout.

Each of the small cluster drive gears powers a modular, similar, satellite gear cluster generally designated respectively 238, 240, 242. The gear clusters are preferably similar in construction but need not necessarily be the same. Each gear cluster comprises a plurality of individual gears which are directly or indirectly rotated by a small cluster drive gear 232, 234 or 236. The individual gears in turn rotate work producing shafts to provide a plurality of rotating shafts for a desired purpose, for example, web transporting, mixing, power transmission and the like. It will be appreciated that although three gear clusters 238, 240, 242 are illustrated, more or fewer similar clusters could be employed as may be necessary to provide the desired number of rotating shafts.

It is contemplated that the various gear clusters 238, 240, 242 will be similarly arranged in balanced patterns and accordingly, only gear cluster 238 need be described in detail, it being understood that the other gear clusters 240, 242 will be similar in design and operation. A pair of driven gears 244, 246 mesh with the first cluster drive gear 232 and preferably are diametrically opposed. Each driven gear 244, 246 in turn meshes with a second pair of driven gears 248, 250 and 252, 254 respectively and the second driven gear pairs 248, 250 and 252, 254 are also diametrically opposed. In the embodiment illustrated, when the gears are diametrically opposed, lines connecting the centers of the pairs of second driven gears 248, 250 and 252, 254 will intersect a line drawn through the centers of the driven gears 244, 246 at right angles. Each of the gears 244, 246 and the second pairs of driven gears 248, 250 and 252, 254 are respectively equipped with shafts 256, 258, 260, 262, 264, 266 for work producing purposes. Each of the shafts journals within the support 202 and projects outwardly therefrom to deliver rotative forces to the point of use. The various shafts 256, 258, 260, 262, 264 and 266 may be equipped with rollers, mixers, propellers, gears etc. (all not shown) as may be desired to accomplish a given work producing purpose. The power shafts 214, 222 and 230 may also be extended for work producing purposes (see FIG. 6) if desired.

The combination of large diameter power transmitting gears 210, 216, 224, and clusters of satellite gears driven by these power gears through coaxially connected cluster drive gears 232, 234 and 236 provide the same advantages as prevail in the system of FIGS. 1 to 4.

It will be understood that other main power transmitting means may be used in lieu of the train of meshing power transmitting gears of FIGS. 3 and 7. For example, in FIG. 8, the large power discs 282, 284, 286 provide the function of power transmitting gears. These discs are shown in FIG. 8 rotated by an eccentric drive 288 which is driven by a suitable power source (not shown) and which eccentrically connected to the large power discs at the respective pins 290, 292, 294 to rotate the power shafts 283, 285, 287. These power shafts 283, 285 and 287 serve as the coacial connections to cluster drive gears (not shown), which in turn drive satellite gear clusters in the manner which characterizes the present invention, as previously explained. In this embodiment (FIG. 8), it would not be meaningful to speak of power gear pitch diameter. The equivalent parameter is the crank circle diameter, which is defined here as the diameter of the circle traced by each pin 290, 292 and 294 as it rotates about its power shaft. This crank circle diameter should be as great as practical and preferably at least three, and in favored cases, about five times the pitch diameter of the coaxially connected cluster drive gears. FIG. 9 illustrates another embodiment utilizing a belt or chain drive 305, which takes power from the drive gear 302 and drive gear shaft 303 and transmits the power directly to the large power transmitting gears 296, 298, 300. Suitable conventional tensioning rollers or gears 304, 306 may be employed if desired. In this manner, the power shafts 297, 299 and 301 will all be rotated in unison.

In FIG. 10, another modification is set forth wherein a power source (not shown) supplies rotative power to the power drive shaft 324. A plurality of miter or bevel gears 326, 328 and 330 are pinned or otherwise affixed to the shaft 324 and are rotated thereby. The bevel gears 326, 328, 330 respectively mesh with the large bevel power gears 318, 320, 322 to rotate the power shafts 319, 321 and 323.

The concept of isolating roller clusters and minimizing transmitted gear forces and bearing reaction forces is applicable regardless of whether the system incorporates spur gearing, worm gearing, bevel gearing, cone gearing, link chains, toothed belts or linkages.

All embodiments heretofore described utilize gears in the satellite clusters and rely on gear tooth meshing between the cluster drive gears and the remaining cluster gears to drive the latter and through them the rollers (or other work producing shafts). It will be understood that other means may be used in lieu of gears, such as adjoining discs, relying on friction between their contacting surfaces to transmit rotation to one another. In such case, the comments previously made, concerning the pitch diameters of cluster gears would apply to diameters of the rotation-transmitting disc surfaces, which would then constitute their driving diameters.

Figure 11:
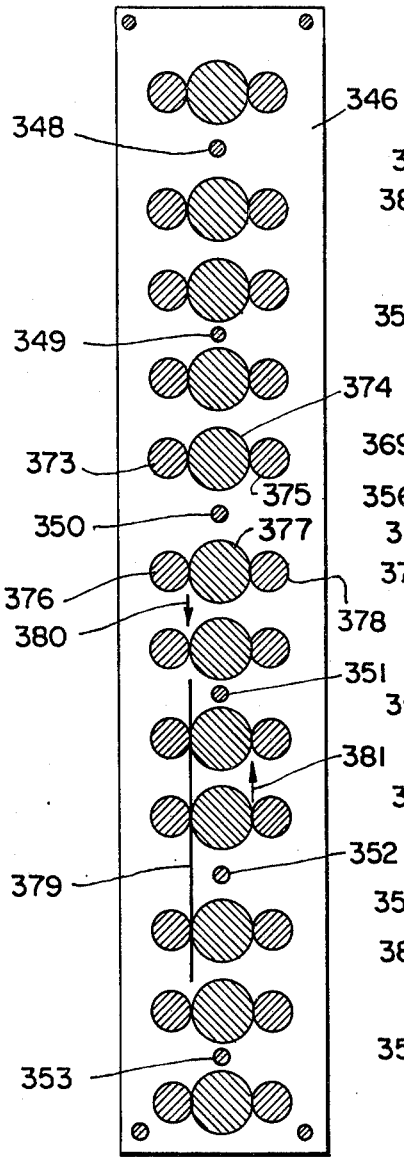
FIG. 11 is a cross sectional view taken through a modified web transporting roller assembly.
Figure 12:
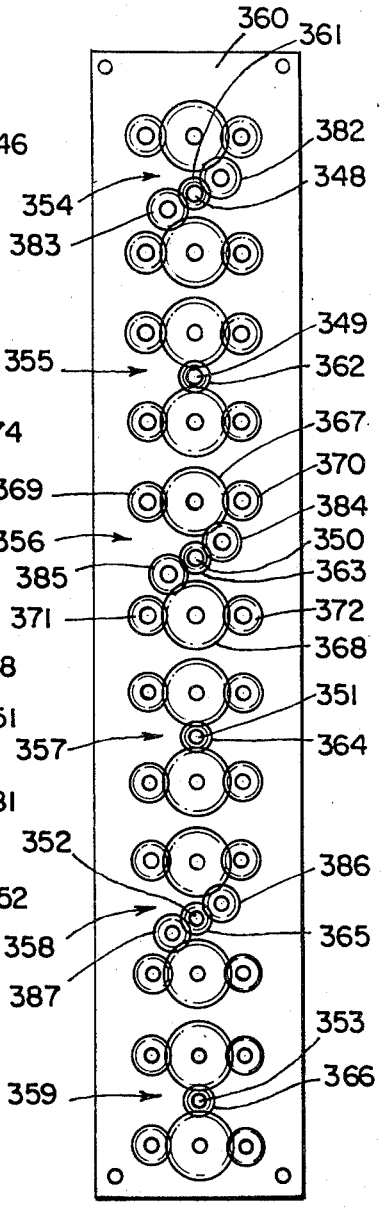
FIG. 12 is a left side elevational view of the roller assembly of FIG. 11 showing the cluster gear arrangement.
Figure 13:
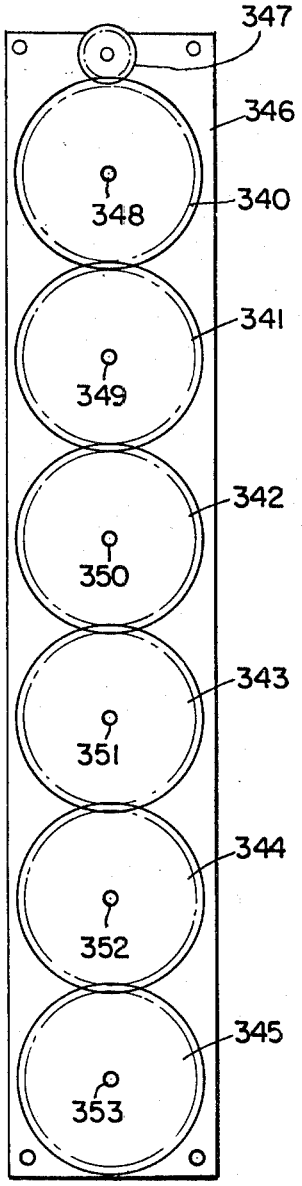
FIG. 13 is a right side elevational view of the roller assembly of FIG. 11 showing the power gear arrangement.

Referring now to FIGS. 11, 12 and 13, these show another embodiment of a gear driven roller system wherein a plurality of large power gears 340, 341, 342, 343, 344, 345 are serially in mesh adjacent a side carrier 346 and rotate simultaneously upon the application of power such as may be delivered by a power drive gear 347. Each large power gear rotates a respective shaft 348, 348, 350, 351, 352, 353 in the manner hereinbefore described.

Rotative power from the large power gears is transmitted to individual satellite gear clusters 354, 355, 356, 357, 358, 359 at the opposite side carrier 360 in a manner similar to that hereinbefore described. A cluster drive gear 361, 362, 363, 364, 365, 366 is affixed to each shaft 348, 349, 350, 351, 352, 353 to rotatively drive all of the gears (for example roller driving gears 367, 368, 369, 370, 371, 372 comprising gear cluster 356) in its satellite gear cluster.

Transport rollers (for example rollers 373, 374, 375, 376, 377, 378 which are driven by the gears of satellite gear cluster 356) are rotatively driven by the gears of each of the satellite gear clusters to transport a web 379 through the system.

If desired, suitable web inlet and outlet rollers (not shown) could be provided at the top of the assembly in a manner similar to that described previously. Likewise bottom turnabout rollers (not shown) could be provided at the bottom of the assembly, if desired, to turn the web 379 as also previously described.

In the embodiment of FIGS. 11 – 13, the large power gears 340, 341, 342, 343, 344, 345 are all in direct mesh with each other, without any intervening reversing gears. In order to rotate all of the rollers in the proper direction to move the web 379 in the directions indicated by the arrows 380, 381, some rotation reversal is necessary. In this embodiment, that is accomplished within the satellite gear clusters. Specifically, pairs of reversing gears, 382, 383, 384, 385 and 386, 387 are included in alternate gear clusters 354, 356, 358, shown in FIG. 12.

It has been found that the advantages of this embodiment are even more pronounced than those of embodiments using reversing gears between power transmitting gears. Without wishing to be bound by this explanation, it is believed that this construction contributes to a further reduction in the number of gears and gear meshes in the main line of power transmission. Also, in this embodiment, all the gears in that main line of power transmission — without any exception for small reversing gears — can have the desired characteristics of being large, having unity gear ratios, and having the largest number of gear teeth.

Still other embodiments may occur to those skilled in the art without departing from the basic concept of the invention.

For example, the transport rollers need not have roller surfaces extending continuously from one side support to the other. They may be formed of several sections, or even of comparatively narrow discs spaced along a common shaft. Rotating brushes may even be used to provide web transport.

It is not always essential that there be two side supports. A single vertical support may be used to carry both the large power transmitting gears, and, on the same hubs, the small cluster drive gears (somewhat as in FIGS. 5, 6 and 7).

It is generally desirable that cluster drive gears rotate coaxially with the respective power transmitting gears. Also it is practical that the cluster drive gear be coaxially connected to its associated power transmitting gear. However, this is not essential. Several other constructions can be built to achieve the purpose of rotating the cluster drive gear without having coaxial rotation with respect to one or more power transmitting wheels or members. Moreover one or more cluster driven gear need not be in frictional engagement with the cluster drive gear. There may be one or more torque transmitting members (such as wheels or gears or other means) positioned intermediate the cluster drive gear and the driven cluster gear (or gears) or member.

Furthermore each power transmitting member, such as gear, and the associated cluster drive member, need not have the pitch (or crank circle) diameter relationship described above. It is sometimes desired to build a conveyor where the pitch diameter (or crank circle) of these pairs of gears be the same, or that of the cluster drive member be a multiple of that of the associated power transmitting gear. In such construction, the cluster drive gear rotates a gear (or suitable rotatable member) which does not rotate a roller. Such gear, however, can be made to actuate any auxiliary device, such as an agitator or mixer for the chemicals, which can rotate at high speed.

It is within the contemplation of the invention that gears be included which are driven by one or more power gears but which gears are not driving what has been called herein, cluster driven gears, or other rotating members. These do not need to conform to the relationship respective the power transmitting gear, which is described above.

Whenever in this description of the invention and in the claims the term "same" or an equivalent term is used, there is meant "substantially" the same.

It is within the contemplation of the invention also that one or more cluster drive member rotate at a rate of rotation different from that of the power transmitting gear. Reduction of the rotational rate of a cluster drive member can be effectuated by any suitable arrangement of devices such as gears, wheels, ratchets, clutches or other suitable means. Such an arrangement can be accomplished regardless of the physical position of that member in the conveyor system of the invention, whether as illustrated in the preferred embodiment, or elsewhere. The cluster drive member in such arrangement is then made to rotate a cluster driven member, such as a gear which operates as described above, to operate the transport member, like a roller. Thus the cluster drive member whether its rate of rotation is the same or different from that of the power transmitting member, has a crank circle (or pitch) diameter smaller than the power transmitting member.

These various and other modifications of the system will provide to one skilled in the art the essential benefits of the invention: the power reduction resulting from the physical disengagement of the members which rotate the gears which carry the load (the transport members) from the main train of power transmitting gears and their physical separation or breaking up into "clusters", as has been called herein.

These, and any other embodiments applying the principles discussed herein to which those skilled in the art may resort, are within the scope of the present invention.

We claim:

1. In a conveyor system for webs having a plurality of rotatable web transporting members, means for supporting said transporting members, and means for driving said transporting members at a speed as to cause uniform transport of the web, the improvement which comprises:

a plurality of power transmitting gears driven simultaneously, means which drives the power gears and which are rotatable in a plane substantially parallel to the plane of rotation of the power gears, a plurality of cluster drive gears coaxially rotated by respective power transmitting gears at the same rate of rotation, a plurality of clusters of gears positioned to be driven by said cluster drive gears, at least some driven gears being connected to rotate transporting members, the pitch diameter of each of said power transmitting gears being a plurality of times the pitch diameter of the cluster drive gear which it rotates, and a reversing gear connected between cluster gears which rotate in the same direction or between power gears which rotate in the same direction.

2. In a conveyor system for webs having a plurality of rotatable web transporting members, means for supporting said transporting members, and means for driving said transporting members at a speed as to cause uniform transport of the web, the improvement which comprises:

a plurality of power transmitting gears driven simultaneously, means which drives the power gears and which are rotatable in a plane substantially parallel to the plane of rotation of the power gears, a plurality of cluster drive gears coaxially rotated by respective power transmitting gears at the same rate of rotation, a plurality of clusters of gears positioned to be driven by said cluster drive gears, at least some driven gears being connected to rotate transporting members, the pitch diameter of each of said power transmitting gears being a plurality of times the pitch diameter of the cluster drive gear which it rotates, and a reversing gear connected between cluster gears which rotate in the same direction.

3. In a conveyor system for webs having a plurality of rotatable web transporting members, means for supporting said transporting members, and means for driving said transporting members at a speed as to cause uniform transport of the web, the improvement which comprises:

a plurality of power transmitting gears driven simultaneously, means which drives the power gears and which are rotatable in a plane substantially parallel to the plane of rotation of the power gears, a plurality of cluster drive gears coaxially rotated by respective power transmitting gears at the same rate of rotation, a plurality of clusters of gears positioned to be driven by said cluster drive gears, at least some driven gears being connected to rotate transporting members, the pitch diameter of each of said power transmitting gears being a plurality of times the pitch diameter of the cluster drive gear which it rotates, and a reversing gear connected between power gears which rotate in the same direction.

4. In a conveyor system for webs having a plurality of rotatable web transporting members, means for supporting said transporting members, and means for driving said transporting members at a speed as to cause uniform transport of the web, the improvement which comprises:

a plurality of rotatable power transmitting members rotated simultaneously by an eccentric drive, means which drives the power transmitting members and which are rotatable in a plane substantially parallel to the plane of rotation of the power gears, a plurality of rotatable cluster drive members coaxially rotated by respective power transmitting members at the same rate of rotation, a plurality of clusters of rotatable members positioned to be driven by cluster drive members, at least some of said driven members being connected to rotate transporting members, and the crank circle diameter of each power transmitting member being larger than the driving diameter of the cluster drive member which it rotates.

5. In a conveyor system for webs having a plurality of rotatable web transporting members, means for supporting said transporting members, and means for driving said transporting members at a speed as to cause uniform transport of the web, the improvement which comprises:

a plurality of rotatable power transmitting members driven simultaneously, means which drives the power transmitting members and which are rotatable in a plane substantially parallel to the plane of rotation of the power transmitting members a plurality of rotatable cluster drive members coaxially rotated by respective power transmitting members at the same rate of rotation, a plurality of clusters of rotatable members positioned to be driven by cluster drive members, at least some of said driven members being connected to rotate transporting members, the crank circle diameter of a plurality of the power transmitting members being a plurality of times the crank circle diameter of its respective cluster drive member which it rotates, said cluster drive member driving a driven member which rotates a transporting member, and wherein cluster driven members are driven by an intermediate member which is driven by the cluster drive member.

6. In a conveyor system for webs having a plurality of rotatable web transporting members, means for supporting said transporting members, and means for driving said transporting members at a speed as to cause uniform transport of the web, the improvement which comprises:

a plurality of power transmitting gears driven simultaneously, means which drives the power gears and which are rotatable in a plane substantially parallel to the plane of rotation of the power gears, a plurality of cluster drive gears coaxially rotated by respective power transmitting gears at the same rate of rotation, a plurality of clusters of gears positioned to be driven by cluster drive gears, at least some driven gears being connected to rotate transporting members, the pitch diameter of a plurality of the power transmitting gears being a plurality of times the pitch diameter of its respective cluster drive gear, said cluster drive gear driving a gear which rotates a transporting member, and wherein cluster driven gears are driven by an intermediate gear which is driven by the cluster drive gear.

7. In a conveyor system for webs having a plurality of rotatable web transporting members, means for driving said transporting members at a speed as to cause uniform transport of the web, the improvement in a rack assembly which comprises:

at least three power transmitting spur gears, spur means for driving the power gears simultaneously, at least three cluster drive gears coaxially rotated by respective power transmitting gears at the same rate of rotation, a plurality of clusters of gears positioned to be driven by said cluster drive gears, at least three of the drive gears driving at least two gears, which in turn drive transporting members, a group of gears and associated transporting members which define a path for turning about and reversing the direction of the course of travel of the web and the transporting members which are rotated by the driven gears define two paths for the film which extend the distance between the axis of two consecutive drive gears, the drive gears in at least one of the clusters driving at least four driven gears, two positioned above and two below the respective drive gear, and the pitch diameter of a plurality of said power transmitting gears being at least about three times the pitch diameter of the cluster drive gear which it rotates, thereby providing multiplication of forces from the power transmitting gears to the cluster drive gears, reducing gear vibration and power requirement for driving the transporting member.

8. The conveyor system of claim 7 wherein at least one group of driven gears has not more than one driven gear not in horizontal alignment with any horizontal plane drawn through the cluster drive gear.

9. In a conveyor system, particularly for webs of emulsion bearing photographic material susceptible to emulsion marking comprising a gear and roller rack assembly unit adapted to be positioned into a compartment of a photographic development equipment, the rack assembly having a plurality of rotatable web transporting members, and means for driving said transporting members at a speed as to cause uniform transport of the web, the improvement in the rack assembly which comprises:

a plurality of power transmitting gears, means which drives the power gears simultaneously and which are rotatable in a plane substantially parallel to the plane of rotation of the power gears, a plurality of cluster drive gears coaxially rotated by respective power transmitting gears at the same rate of rotation, a plurality of clusters of gears positioned to be driven by said cluster drive gears, at least some driven gears being connected to rotate transporting members, a cluster of gears having a plurality of driven gears which rotate transporting members, the transporting members which are rotated by the driven gears defining two paths for the photographic material which extend the distance between the axes of two consecutive cluster drive gears, cluster driven gears being driven by an intermediate gear which is driven by the cluster drive gear, and the pitch diameter of a plurality of said power transmitting gears being a plurality of times the pitch diameter of the cluster drive gear which it rotates, thereby providing multiplication of forces from the power transmitting gears to the cluster drive gears, reducing gear vibration and power requirement for driving the rack.

10. The conveyor system of claim 9 wherein the plurality of times of pitch diameter is at least about three.

11. The conveyor system of claim 9 wherein the gears driven by a cluster gear include two gears of a larger diameter than the cluster drive gear by which they are rotated.

12. The conveyor system of claim 9 wherein at least one of the driven gears has at least two drive gears positioned laterally with respect to the gear which drives it.

13. The conveyor system of claim 9 wherein the two laterally positioned gears are positioned generally in a same horizontal plane as the axis of the gear which drives them.

14. The conveyor system of claim 9 wherein the drive gears drive at least two driven gears positioned one below and one above the respective drive gears, each driven gear driving at least two other driven gears positioned laterally with respect to the respective gear which drives it, the drive gear which is rotated by the power transmitting gear, and the gears driven by it forming a cluster of at least six gears, the driven gears driving the transport members.

15. The conveyor system of claim 9 which includes at least three power gears with their associated drive and driven gears, which rotate transport members.

16. The conveyor system of claim 9 wherein the power transmitting gears comprise a gear whose pitch diameter is not a plurality of times the pitch diameter of the cluster drive gear which it rotates.

17. The conveyor system of 9 wherein said gear drives an agitator.

18. In a conveyor system, particularly for webs of emulsion bearing photographic material susceptible to emulsion marking, comprising a gear and roller rack assembly unit adapted to be positioned into a compartment of a photographic development equipment, the rack assembly having a plurality of rotatable web transporting members, means for supporting said transporting members, and means for driving said transporting members at a speed as to cause uniform transport of the web, the improvement in the rack assembly which comprises:

a plurality of power transmitting gears, means which drives the power gears simultaneously and which are rotatable in a plane substantially parallel to the plane of rotation of the power gears, a reversing gear positioned between two consecutive power transmitting gears, a plurality of cluster drive gears coaxially rotated by respective power transmitting gears at the same rate of rotation, a plurality of clusters of gears positioned to be driven by said cluster drive gears, at least some driven gears being connected to rotate transporting members, a cluster of gears having a plurality of driven gears which rotate transporting members, the transporting members which are rotated by the driven gears defining downward and upward paths for the photographic material which extend the distance between the axes of two consecutive cluster drive gears, the pitch diameter of a plurality of said power transmitting gears being a plurality of times the pitch diameter of the cluster drive gear which it rotates, thereby providing multiplication of forces from the power transmitting gears to the cluster drive gears, reducing gear vibration and power requirement for driving the rack, a turn-about group of associated gears and transporting members positioned on the rack so as to be spaced apart from the most remote cluster drive gear and its associated cluster of driven gears on the rack, by at least one cluster drive gear, their associated driven gears, and their transporting members, the turn-about group of associated gears and transporting members comprising a power transmitting gear, a cluster drive gear coaxially rotated by the power transmitting gear at the same rate of rotation and a plurality of cluster driven gears positioned to be driven by the cluster drive gear, at least some of the cluster driven gears being positioned below the cluster drive gear and at least some of these driven gears being connected to rotate transporting members to define a path for turning-about the photographic material and to reverse its course of direction.

19. The conveyor system of claim 18 wherein the reversing gear has a smaller diameter than the power transmitting gears.

20. In a conveyor system, particularly for webs of emulsion bearing photographic material susceptible to emulsion marking, comprising a gear and roller rack assembly unit adapted to be positioned into a compartment of a photographic development equipment, the rack assembly having a plurality of rotatable web transporting members, means for supporting said transporting members, and means for driving said transporting members at a speed as to cause uniform transport of the web, the improvement in the rack assembly which comprises:

a plurality of power transmitting gears, means which drives the power gears simultaneously and which are rotatable in a plane substantially parallel to the plane of rotation of the power gears, a plurality of cluster drive gears coaxially rotated by respective power transmitting gears at the same rate of rotation, a plurality of clusters of gears positioned to be driven by said cluster drive gears, at least some driven gears being connected to rotate transporting members, a cluster of gears having a plurality of driven gears which rotate transporting members, the transporting members which are rotated by the driven gears defining downward and upward paths for the photographic material which extend the distance between the axes of two consecutive cluster drive gears, a reversing gear connected between cluster gears, the pitch diameter of a plurality of said power transmitting gears being a plurality of times the pitch diameter of the cluster drive gear which it rotates, thereby providing multiplication of forces from the power transmitting gears to the cluster drive gears, reducing gear vibration and power requirement for driving the rack, a turn-about group of associated gears and transporting members positioned on the rack so as to be spaced apart from the most remote cluster drive gear and its associated cluster of driven gears on the rack, by at least one cluster drive gear, their associated driven gears, and their transporting members, the turn-about group of associated gears and transporting members comprising a power transmitting gear, a cluster drive gear coaxially rotated by the power transmitting gear at the same rate of rotation and a plurality of cluster driven gears positioned to be driven by the cluster drive gear, at least some of the cluster driven gears being positioned below the cluster drive gear and at least some of these driven gears being connected to rotate transporting members to define a path for turning-about the photographic material and to reverse its course of direction.

21. The conveyor system of claim 20 wherein at least two cluster drive gears drive at least two cluster driven gears, which in turn drive at least two driven gears.

22. The conveyor system of claim 20 wherein at least two cluster drive gears drive each one a pair of cluster driven gears positioned substantially vertically respective the cluster drive gear.

23. In a conveyor system, particularly for webs of emulsion bearing photographic material susceptible to emulsion marking, comprising a gear and roller rack assembly unit adapted to be positioned into a compartment of a photographic development equipment, the rack assembly having a plurality of rotatable web transporting members, means for supporting said transporting members, and means for driving said transporting members at a speed as to cause uniform transport of the web, the improvement in the rack assembly which comprises:

a plurality of power transmitting gears, means which drives the power gears simultaneously and which are rotatable in a plane substantially parallel to the plane of rotation of the power gears, a plurality of cluster drive gears coaxially rotated by respective power transmitting gears at the same rate of rotation, a plurality of clusters of gears positioned to be driven by said cluster drive gears, gears driven by a cluster drive gear includes one gear driven directly, and one gear driven indirectly, respectively by the cluster drive gear which rotates them both, at least some driven gears being connected to rotate transporting members, a cluster of gears having a plurality of driven gears which rotate transporting members, the transporting members which are rotated by the driven gears defining two paths for the photographic material which extend the distance between the axes of two consecutive cluster drive gears, and the pitch diameter of a plurality of said power transmitting gears being a plurality of times the pitch diameter of the cluster drive gear which it rotates, thereby providing multiplication of forces from the power transmitting gears to the cluster drive gears, reducing gear vibration and power requirement for driving the rack.

24. The conveyor system of claim 23 wherein the gear which is driven directly by its cluster drive gear is of a larger diameter than the cluster drive gear.

25. The conveyor system of claim 23 wherein the drive gears are smaller in diameter than at least two of the gears driven by these drive gears, the driven gears driving the transport members.

26. The conveyor system of claim 9 wherein the web transporting members are positioned intermediate the power transmitting gears and the cluster of driven gears.

27. The conveyor system of claim 9 wherein the rack unit comprises support members respectively affixed at the same end of the transporting members, the power transmitting gears and the cluster drive gears thus being positioned adjacent the same one of these respective support members.

28. In a conveyor system, particularly for webs of emulsion bearing photographic material susceptible to emulsion marking comprising a gear and roller rack assembly unit adapted to be positioned into a compartment of a photographic development equipment, the rack assembly having a plurality of rotatable web transporting members, and means for driving said transporting members at a speed as to cause uniform transport of the web, the improvement in the rack assembly which comprises:

a plurality of rotatable power transmitting members driven simultaneously, means which drive the power transmitting members and which are rotatable in a plane substantially parallel to the plane of rotation of the power transmitting members, a plurality of rotatable cluster drive members rotated by respective power transmitting members, a plurality of clusters of rotatable members positioned to be driven by cluster drive members, at least some of said driven members being connected to rotate transporting members, the crank circle diameter of a plurality of the power transmitting members being larger than the crank circle diameter of its respective cluster drive member which it rotates, said cluster drive member driving a driven member which rotates a transporting member, and wherein cluster driven members are driven by an intermediate member which is driven by the cluster drive member.

29. In a conveyor system, particularly for webs of emulsion bearing photographic material susceptible to emulsion marking comprising a gear and roller rack assembly unit adapted to be positioned into a compartment of a photographic development equipment, the rack assembly having a plurality of rotatable web transporting members, and means for driving said transporting members at a speed as to cause uniform transport of the web, the improvement in the rack assembly which comprises:

a plurality of power transmitting gears driven simultaneously, means which drive the power gears and which are rotatable in a plane substantially parallel to the plane of rotation of the power gears, a plurality of cluster drive gears coaxially rotated by respective power transmitting gears at the same rate of rotation, a plurality of clusters of gears positioned to be driven by cluster drive gears, at least some driven gears being connected to rotate transporting members, the pitch diameter of a plurality of the power transmitting gears being larger than the pitch diameter of its respective cluster drive gear, said cluster drive gear driving a gear which rotates a transporting member, and wherein cluster driven gears are driven by an intermediate gear which is driven by the cluster drive gear.

30. The conveyor system of claim 29 including a turn-about group of associated gears and transporting members which comprises a power transmitting gear, a cluster drive gear coaxially rotated by the power transmitting gear at the same rate of rotation and a plurality of cluster driven gears positioned to be driven by the cluster drive gear, at least some of the cluster driven gears being positioned below the cluster drive gear and at least some of these driven gears being connected to rotate transporting members to define a path for turning-about a web and to reverse its course of direction.

31. The conveyor system of claim 30 which includes at least three vertically spaced power transmitting gears with their associated drive and driven gears, at least some of said associated driven gears being connected to rotate transporting members.

32. The conveyor system of claim 31 wherein a cluster drive gear rotates a lead-in and out group of gears which drive transporting members for directing a web into and out of the system, the cluster drive gear which rotates the lead-in and out group of gears being spaced apart from the cluster drive gear of the turn-about group of gears by at least two cluster drive gears and their associated cluster of driven gears.

33. The conveyor system of claim 32 wherein the gears driven by a cluster drive gear include one gear of a larger diameter than the cluster drive gear by which it is rotated.

34. The conveyor system of claim 33 wherein the turn-about group of associated gears and transporting members is positioned so as to be spaced apart from the most remote cluster drive gear and its associated cluster of driven gears by at least one cluster drive gear, their associated driven gears, and their transporting members.

35. The conveyor system of claim 34 wherein the gears driven by cluster drive gear include two gears of a larger diameter than the cluster drive gear by which it is rotated.

36. The conveyor system of claim 32 wherein the intermediate gear is driven directly by the cluster drive gear.

37. The conveyor system of claim 32 wherein at least two clusters of driven gears include an intermediate gear which is driven directly by a cluster drive gear.

38. The conveyor system of claim 32 wherein a cluster of driven gears includes at least two intermediate gears which are driven directly by a cluster drive gear.

39. The conveyor system of claim 32 wherein a gear driven by the intermediate gear is of a smaller diameter than the cluster drive gear.

40. The conveyor system of claim 32 wherein the intermediate gear is of a larger diameter than the cluster drive gear which rotates it.

41. The conveyor system of claim 32 wherein the intermediate gear drives a gear directly and one gear indirectly through another gear.

42. The conveyor system of claim 32 wherein at least two cluster driven gears are driven by the intermediate gear and are positioned laterally with respect to the intermediate gear.

43. The conveyor system of claim 32 wherein the drive gears drive at least four driven gears, two positioned above and two below the respective drive gear.

44. The conveyor system of claim 32 which comprises at least one group of driven gears having not more than one driven gear, which is directly driven by a cluster drive gear, in horizontal alignment with any horizontal plane drawn through the cluster drive gear.

45. The conveyor system of claim 32 wherein at least two cluster drive gears drive each one of a pair of cluster driven gears positioned substantially vertically respective the cluster drive gear.

46. The conveyor system of claim 32 wherein a cluster of driven gears includes a plurality of driven gears in vertical alignment with the cluster drive gear and another cluster includes a plurality of driven gears not in vertical alignment with the cluster drive gear.

47. The conveyor system of claim 29 wherein the cluster drive gears which are coaxially rotated by respective power transmitting gears are rotated by a shaft, which shaft does not attach directly to a roller.

48. The conveyor system of claim 29 wherein a reversing gear is connected between cluster gears.

49. The conveyor system of claim 29 wherein a reversing gear is connected between power transmitting gears.

50. In a conveyor system, particularly for webs of emulsion bearing photographic material susceptible to emulsion marking, comprising a gear and roller rack assembly unit adapted to be positioned into a compartment of a photographic development equipment, the rack assembly having a plurality of rotatable web transporting members, means for supporting said transporting members, and means for driving said transporting members at a speed as to cause uniform transport of the web, the improvement in the rack assembly which comprises:

a plurality of power transmitting gears transmitting the power consecutively to each other, means which drives the power gears simultaneously and which are rotatable in a plane substantially parallel to the plane of rotation of the power gears, a plurality of cluster drive gears coaxially rotated by respective power transmitting gears at the same rate of rotation.

a plurality of clusters of gears positioned to be driven by said cluster drive gears, the gears driven by a cluster drive gear including one gear of a larger diameter than the cluster drive gear by which it is rotated, at least some driven gears being connected to rotate transporting members, a cluster of gears having a plurality of driven gears which rotate transporting members, the transporting members which are rotated by the driven gears defining two paths for the photographic material which extend the distance between the axes of two consecutive cluster drive gears, the pitch diameter of each of said power transmitting gears being a plurality of times the pitch diameter of the cluster drive gear which it rotates, thereby providing multiplication of forces from the power transmitting gears to the cluster drive gears, reducing gear vibration and power requirement for driving the rack.

51. The conveyor system of claim 50 wherein the gears include two gears of a larger diameter than the cluster drive gear by which it is rotated.

52. The conveyor system of claim 50 wherein the web transporting members are positioned intermediate the power transmitting gears and the cluster of driven gears.

53. The conveyor system of claim 50 wherein the rack unit comprises support members respectively affixed at the same end of the transporting members, the power transmitting gears and the cluster drive gears thus being positioned adjacent the same one of these respective support members.

54. In a conveyor system, particularly for webs of emulsion bearing photographic material susceptible to emulsion marking, comprising gear and roller rack assembly unit adapted to be positioned into a compartment of a photographic development equipment, the rack assembly having a plurality of rotatable web transporting members, means for supporting said transporting members, and means for driving said transporting members at a speed as to cause uniform transport of the web, the improvement in the rack assembly which comprises:

a plurality of power gears transmitting power consecutively to each other, a plurality of cluster drive gears coaxially rotated by respective power transmitting gears at the same rate of rotation, a plurality of clusters of gears positioned to be driven by said cluster drive gears, at least some driven gears being connected to rotate transporting members, a cluster of gears having a plurality of driven gears which rotate transporting members, the transporting members which are rotated by the driven gears defining a downward and an upward path for the photographic material which extend the distance between the axes of two consecutive cluster drive gears, the pitch diameter of each of said power transmitting gears being a plurality of times the pitch diameter of the cluster drive gear which it rotates, thereby providing multiplication of forces from the power transmitting gears to the cluster drive gears, reducing gear vibration and power requirement for driving the rack, a turnabout group of associated gears and transporting members positioned on the rack so as to be spaced apart from the most remote cluster drive gear and its associated cluster of driven gears on the rack, by at least one cluster drive gear, their associated driven gears, and their transporting members, the turnabout group of associated gears and transporting members comprising a power transmitting gear, a cluster drive gear coaxially rotated by the power transmitting gear at the same rate of rotation and a plurality of cluster driven gears positioned to be driven by the cluster drive gear, at least some of the cluster driven gears being positioned below the cluster drive gear and at least some of these driven gears being connected to rotate transporting members to define a path for turning-about the photographic material and to reverse its course of direction.

55. In a conveyor system, paricularly for webs of emulsion bearing photographic material susceptible to emulsion marking, comprising a gear and roller rack assembly unit adapted to be positioned into a compartment of a photographic development equipment, the rack assembly having a plurality of rotatable web transporting members, means for supporting said transporting members, and means for driving said transporting members at a speed as to cause uniform transport of the web, the improvement in the rack assembly which comprises:

a plurality of power transmitting gears, means which drives the power gears simultaneously and which are rotatable in a plane substantially parallel to the plane of rotation of the power gears, a plurality of cluster drive gears coaxially rotated by respective power transmitting gears at the same rate of rotation, a plurality of clusters of gears positioned to be driven by said cluster drive gears, at least some driven gears being connected to rotate transporting members, a cluster of gears having a plurality of driven gears which rotate transporting members, the transporting members which are rotated by the driven gears defining a downward and an upward path for the photographic material which extend the distance between the axes of two consecutive cluster drive gears, the pitch diameter of each of said power transmitting gears being a plurality of times the pitch diameter of the cluster drive gear which it rotates, thereby providing multiplication of forces from the power transmitting gears to the cluster drive gears, reducing gear vibration and power requirement for driving the rack, a turnabout group of associated gears and transporting members positioned on the rack so as to be spaced apart from the most remote cluster drive gear and its associate cluster of driven gears on the rack, by at least one cluster drive gear, their associated driven gears, and their transporting members, the turn-about group of associated gears and transporting members comprising a power transmitting gear, a cluster drive gear coaxially rotated by the power transmitting gear at the same rate of rotation and a plurality of cluster driven gears positioned to be driven by the cluster drive gear, at least some of the cluster driven gears being positioned below the cluster drive gear and at least some of these driven gears being connected to rotate transporting members to define a path for turning-about the photographic material and to reverse its course of direction, at least two of the cluster drive gears have respective driven gears positioned not in horizontal alignment with the axis of the respective cluster drive gears.

56. In a conveyor system, particularly for webs of emulsion bearing photographic material susceptible to emulsion marking, comprising a gear and roller rack assembly unit adapted to be positioned into a compartment of a photographic development equipment, the rack assembly having a plurality of rotatable web transporting members, means for supporting said transporting members, and means for driving said transporting members at a speed as to cause uniform transport of the web, the improvement in the rack assembly which comprises:

a plurality of power transmitting gears, means which drives the power gears simultaneously and which are rotatable in a plane substantially parallel to the plane of rotation of the power gears, a plurality of cluster drive gears coaxially rotated by respective power transmitting gears at the same rate of rotation, a plurality of clusters of gears positioned to be driven by said cluster drive gears, at least some driven gears being connected to rotate transporting members, a cluster of gears having a plurality of driven gears which rotate transporting members, the transporting members which are rotated by the driven gears defining a downward and an upward path for the photographic material which extend the distance between the axes of two consecutive cluster drive gears, the pitch diameter of each of said power transmitting gears being a plurality of times the pitch diameter of the cluster drive gear which it rotates, thereby providing multiplication of forces from the power transmitting gears to the cluster drive gears, reducing gear vibration and power requirement for driving the rack, a turnabout group of associated gears and transporting members positioned on the rack so as to be spaced apart from the most remote cluster drive gear and its associate cluster of driven gear, their associated driven gears, and their transporting members, the turn-about group of associated gears and transporting members comprising a power transmitting gear, a cluster drive gear coaxially rotated by the power transmitting gear at the same rate of rotation and a plurality of cluster driven gears positioned to be driven by the cluster drive gear, at least some of the cluster driven gears being positioned below the cluster drive gear and at least some of these driven gears being connected to rotate transporting members to define a path for turning-about the photographic material and to reverse its course of direction, at least two of the cluster driven gears being out of vertical alignment with the axis of the cluster drive gear.

57. In a conveyor system, particularly for webs of emulsion bearing photographic material susceptible to emulsion marking, comprising a gear and roller rack assembly unit adapted to be positioned into a compartment of a photographic development equipment, the rack assembly having a plurality of rotatable web transporting members, means for supporting said transporting members, and means for driving said transporting members at a speed as to cause uniform transport of the web, the improvement in the rack assembly which comprises:

a plurality of rotatable power transmitting members transmitting the power consecutively to each other, a plurality of cluster drive members coaxially rotated by respective power transmitting members at the same rate of rotation, a plurality of clusters of rotatable members positioned to be driven by said cluster drive members, at least some driven members being connected to rotate transporting members, a cluster of gears having a plurality of gears which rotate transporting members, the transporting members which are rotated by the driven members defining two paths for the photographic material which extend the distance between the axes of two consecutive cluster drive members, the crank circle diameter of a plurality of power transmitting members being larger than the driving diameter of the cluster drive member which it rotates, thereby providing multiplication of forces from the power transmitting members to the cluster drive members, reducing gear vibration and power requirement for driving the rack.

58. The conveyor system of claim 57 wherein the cluster drive members are coaxially connected to the power transmitting members.

59. The conveyor system of claim 59 wherein the crank circle diameter of the majority of the power transmitting members is larger than the driving diameter of the cluster drive member.

60. The conveyor system of claim 59 wherein the crank circle diameter of the power transmitting members is several times larger than the driving diameter of the cluster drive member which it rotates.

61. The conveyor system of claim 57 wherein each cluster drive member is connected to the respective power transmitting member.

62. The conveyor system of claim 57 wherein the transporting members are rollers.

63. The conveyor system of claim 62 wherein some of the rollers are of different diameters than others.

64. The conveyor system of claim 57 wherein a cluster drive member drives at least two cluster driven members.

65. The conveyor system of claim 64 wherein a plurality of cluster drive members drive at least two cluster driven members.

66. In a conveyor system, particularly for webs of emulsion bearing photographic material susceptible to emulsion marking, comprising a gear and roller rack assembly unit adapted to be positioned into a compartment of a photographic development equipment, the rack assembly having a plurality of rotatable web transporting members, means for supporting said transporting members, and means for driving said transporting members at a speed as to cause uniform transport of the web, the improvement in the rack assembly which comprises:

a plurality of power gears transmitting the power consecutively to each other, a plurality of cluster drive gears coaxially rotated by respective power transmitting gears at the same rate of rotation, a plurality of clusters of gears positioned to be driven by said cluster drive gears, at least some driven gears being connected to rotate transporting members, a cluster of gears having a plurality of gears which rotate transporting members, the transporting members which are rotated by the driven gears defining two paths for the photographic material which extend the distance between the axes of two consecutive cluster drive gears, the pitch diameter of a plurality of said power transmitting gears being larger than the pitch diameter of the cluster drive gear which it rotates, thereby providing multiplication of forces from the power transmitting gears to the cluster drive gears, reducing gear vibration and power requirement for driving the rack.

67. The conveyor system of claim 66 wherein the power gears are meshed in series.

68. The conveyor system of claim 67 which comprises a reversing gear between two power gears which rotate in the same direction.

69. The conveyor system of claim 67 which comprises a reversing gear between every two power gears which rotate in the same direction.

70. The conveyor system of claim 66 which includes at least three power gears transmitting the power consecutively to each other.

71. The conveyor system of claim 66 which includes at least four power gears transmitting the power consecutively to each other.

72. The conveyor system of claim 66 which includes five power gears transmitting the power consecutively to each other.

73. The conveyor system of claim 66 wherein the power gears and the reversing gears are spur gears meshed in series.

74. The conveyor system of claim 66 which comprises spur means which drives the power gears.

75. The conveyor system of claim 66 wherein the ratio of pitch diameter of one power gear to the cluster drive gear which it rotates is different from the ratio of the pitch diameter of another power gear to another cluster drive gear.

76. The conveyor system of claim 66 wherein the ratio pitch diameter of the power gears to the respective associated cluster drive gears in a rack are all different for each of the power gears and the respective associated drive gear.

77. The conveyor system of claim 66 wherein the ratio of power gears to associated cluster drive gears is selected from at least one of the following: 1 to about 3, 1 to about 4 and 1 to about 5.

78. The conveyor system of claim 66 wherein the pitch diameter of the power gears is larger than the pitch diameter of the cluster drive gear by an integral number.

79. The conveyor system of claim 66 wherein the pitch diameter of the power gears is larger than the pitch diameter of the cluster drive gear by a fractional number.

80. The conveyor system of claim 78 wherein the integral number is from about 3 to about 5.

81. The conveyor system of claim 66 which comprises five power gears with their associated cluster drive and driven gears.

82. The conveyor system of claim 66 which comprises six power gears with their associated cluster drive and driven gears.

83. The conveyor system of claim 66 wherein the cluster drive gears which are coaxially rotated each one by a respective power transmitting gear, are rotated by a shaft, which shaft does not directly attach to nor carry a roller.

84. The conveyor system of claim 66 wherein a first one of the power transmitting gears which through its cluster drive gear rotates a lead-in and -out group of gears which drive transport members, which group is positioned near one end of the rack assembly and cooperates with the cluster driven gears and the transporting members rotated by the cluster drive gears, to define a path for guiding the photographic material automatically into and out of the assembly, a second one of the power transmitting gears which through its cluster drive gear rotates a turn-about group of gears which is positioned near the opposite end of the rack assembly and cooperates with the cluster driven gears and the transporting members rotated by those cluster driven gears to define a path for turning-about the photographic material and reversing its course of direction.

85. The conveyor system of claim 84 which comprises at least two additional power transmitting gears positioned between said first and second power transmitting gears, which in turn drive the cluster drive gears and, in turn, the transporting members.

86. The conveyor system of claim 66 wherein a plurality of cluster driven gears are driven by an intermediate gear, which is driven by the cluster drive gear.

87. The conveyor system of claim 66 wherein each power transmitting gear is connected to a cluster drive gear.

88. The conveyor system of claim 87 wherein all power transmitting gears are driven by one driving member.

89. The conveyor system of claim 66 wherein some of the power transmitting gears have substantially the same pitch diameter.

90. The conveyor system of claim 66 wherein at least one cluster has no gear meshing with any gear of any other cluster.

91. The conveyor system of claim 66 wherein each power transmitting gear is a plurality of times the pitch diameter of the cluster drive gear which rotates, and which is the cluster drive gear which drives the gear which rotates the transporting member.

92. The conveyor system of claim 66 wherein the power transmitting gears comprise further a gear whose pitch diameter is not a plurality of times the pitch diameter of the cluster drive gear which it rotates.

93. The conveyor system of claim 92 wherein said gear drives an agitator.

94. The conveyor system of claim 66 wherein said plurality of driven gears is positioned symmetrically about a cluster drive gear.

95. The conveyor system of claim 66 wherein a driven gear driven by a cluster drive gear meshes with a driven gear driven by another cluster drive gear.

96. The conveyor system of claim 66 wherein said webs are of information bearing material.

97. The conveyor system of claim 96 wherein said webs are of photographic material.

98. The conveyor system of claim 97 wherein the photographic material is paper.

99. The conveyor system of claim 66 wherein said webs are film.

100. The conveyor system of claim 66 wherein a cluster drive member rotate at a rate of rotation different from that of the power transmitting gear.

101. The conveyor system of claim 100 wherein the cluster drive member has a reduced rotational rate respective the power transmitting gear.

* * * * *